US005782446A

United States Patent [19]

Ghahremani

[11] Patent Number: 5,782,446

[45] Date of Patent: Jul. 21, 1998

[54] DAVIT MOUNTING ASSEMBLY

[75] Inventor: Ali Ghahremani, Granada Hills, Calif.

[73] Assignee: Skymaster, Inc., City of Industry, Calif.

[21] Appl. No.: 785,906

[22] Filed: Jan. 21, 1997

[51] Int. Cl.[6] ..... F16M 13/00

[52] U.S. Cl. ..... 248/220.21; 248/500; 248/221.11; 248/289.11

[58] Field of Search ..... 248/500, 220.21, 248/221.11, 224.7, 289.11, 291.1

[56] References Cited

U.S. PATENT DOCUMENTS 4,545,558 10/1985 Crudele .

4,714,226 12/1987 Tracy .

5,065,838 11/1991 Finley .

5,544,851 8/1996 Moore ..... 248/291.1 X

*Primary Examiner*—James R. Brittain

*Attorney, Agent, or Firm*—Boniard I. Brown

[57] ABSTRACT

An improved davit mounting assembly is provided which is mounted on a generally circular mounting plate to enable positioning of the assembly at any selected rotational angle to accommodaate particular building structural contours or features. The davit mounting assembly is removably and rotatably mounted on the circular mounting plate.

11 Claims, 2 Drawing Sheets

DAVIT MOUNTING ASSEMBLY

BACKGROUND AND SUMMARY OF THE INVENTION

1. Field of the Invention

The present invention relates generally to davit mounting assemblies for supporting platforms suspended from building structures, as for workmen-service personnel; more particularly, the invention relates to an improved davit mounting assembly wherein the assembly is mounted on a generally circular mounting plate to enable positioning of the davit mounting assembly at any selected angle to accommodate particular building structural contours and features.

2. Prior Art

Roof mounted and elevated platform suspension systems, apparatus and assemblies have long been utilized for access by service personnel and workmen to the sides of buildings and structures, particularly tall buildings. Bent arm davits have long been utilized, as have davits removably mounted in sockets positioned in davit mounting assemblies. As is well-known, repair services and window cleaning operations on multi-story buildings require the suspension of persons, typically on platforms, from elevated surfaces, such as roof tops, in order to reach areas which are otherwise inaccessible. A davit is typically mounted on the roof or other elevated surface in a mounting socket and suspension lines extend from the davit to support the platform, typically two davits being utilized. A davit mounting arrangement must ordinarily be mobile in order that the platform may be moved about and across the surfaces or side walls of buildings.

A prior art davit mounting arrangement is shown and described in U.S. Pat. No. 4,714,226 to Tracy. A platform-suspending davit mounting apparatus is shown and described in U.S. Pat. No. 4,545,558 to Crudele.

Some prior art assemblies and arrangements have involved utilization of parapet walls, either with booms supported on a roof so the apparatus can avoid the parapet wall, or being mounted on parapet walls, with runways to accommodate davit-mounting assemblies. A parapet-utilizing arrangement is shown and described in U.S. Pat. No. 5,065,838 to Finley.

BRIEF SUMMARY OF THE INVENTION

The present invention provides an improved davit mounting assembly wherein the assembly is mounted on a generally circular mounting plate, thus to enable the positioning of the davit mounting assembly at any selected rotational angle to accommodate any particular building structural contours or features. The assembly is adapted to be removably and rotatably mounted on the circular mounting plate, as by spaced-apart hook members mounted on a support plate to receive the mounting plate in rotatable relation to the support plate. The socket is preferably pivotably mounted on spaced-apart wall members for rotation to a position to facilitate insertion and removal of a davit.

DESCRIPTION OF THE PREFERRED EMBODIMENT

Figure 2:
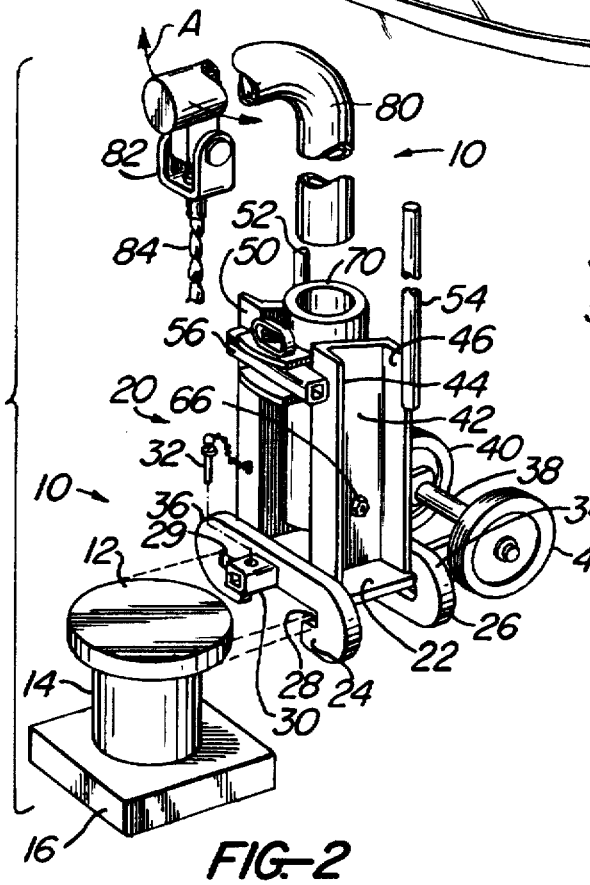
FIG. 2 is an exploded perspective view of a preferred embodiment of the invention, showing the manner in which the assembly is engaged with a generally circular mounting plate.
Figure 3:
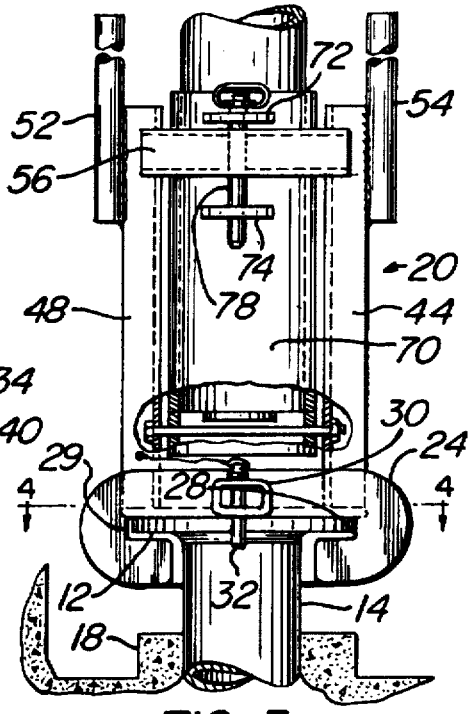
FIG. 3 is an elevational view of the embodiment of FIG. 2, and showing the mounting of a base portion in concrete.

Referring to the drawings, there is shown a preferred embodiment of the present invention which comprises a mounting assembly 10 and a davit mount assembly 20 (FIGS. 2 and 3). The mounting assembly comprises a generally circular mounting plate 12 according to the invention, a pedestal 14 and a base 16, the latter being secured to a structure such as a roof top by welding or bolting to a metal member (not shown) or by embedding in concrete, as indicated at 18 in FIG. 3, typically by embedding Jay-bolts.

Figure 4:
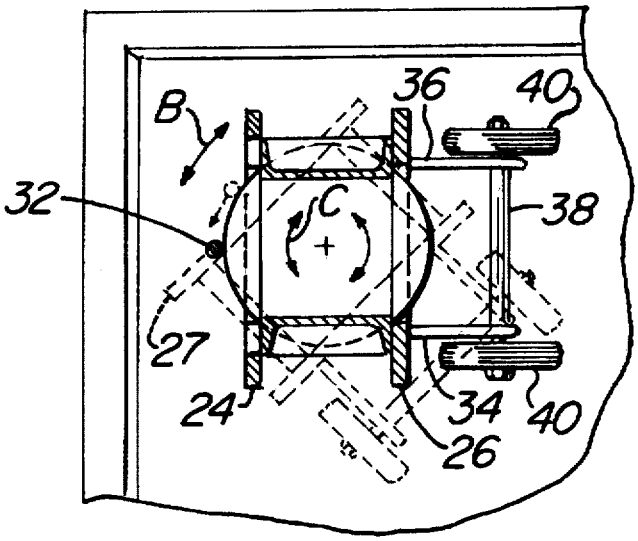
FIG. 4 is a sectional view, taken at line 4—4 in FIG. 3, showing the versatile rotational positioning capability according to the invention.

Secured, as by welding, to a support member 22 are two spaced-apart hook members 24, 26 at opposite ends of support member 22. Each of the hook members defines receiving channels 28, 29 (FIG. 2) which are sized and configurated to receive the mounting plate 12 (FIGS. 2 and 4). Extending outwardly from hook member 24 is a tubular member 30 of rectilinear crosssection, which has registering openings in its upper and lower walls, which are adapted to receive a securing pin 32, for a purpose later described.

Extending outwardly from hook member 26 are spaced-apart arms 34, 36, secured as by welding, in which is rotatably mounted an axle 38 for wheels 40. The hook members are adapted and configurated to receive the circular mounting plate 12 in their receiving channels 28, 29, which extends therethrough, and is retained therebetween, by hook member 26 (FIGS. 2 and 4).

Secured to support member 22, as by welding, and extending upwardly therefrom are secured, as by welding, in spaced relation first and second channel members 42, 44 (FIG. 2), member 42 having outwardly extending walls 44, 46, and member 50 having similar channel walls including wall 50. Extending upwardly from upper portions of wall 46 of member 42 and the rearward wall of member 44 (not shown) are handles 52, 54 for manual grasping for manipulation of the davit mount assembly.

Figure 5:
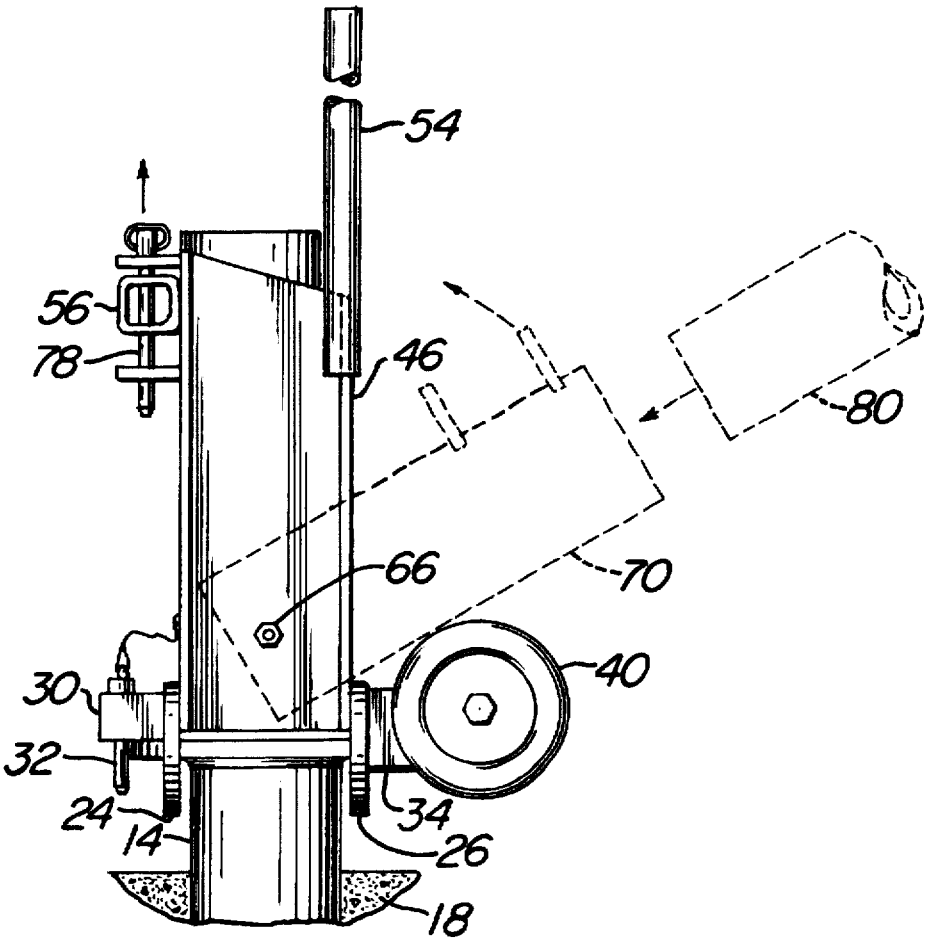
FIG. 5 is a side elevational view of the embodiment of FIGS. 2 and 3, showing in phantom outline a downwardly-inclined position of a socket member for insertion or removal of a davit.

A tubular member 56, of rectangular cross-section, is secured, as by welding, between channel members 42 and 44. Registering openings are defined in the upper and lower walls of member 56, and a pin 78 is insertable through the openings (FIG. 5).

Figure 1:
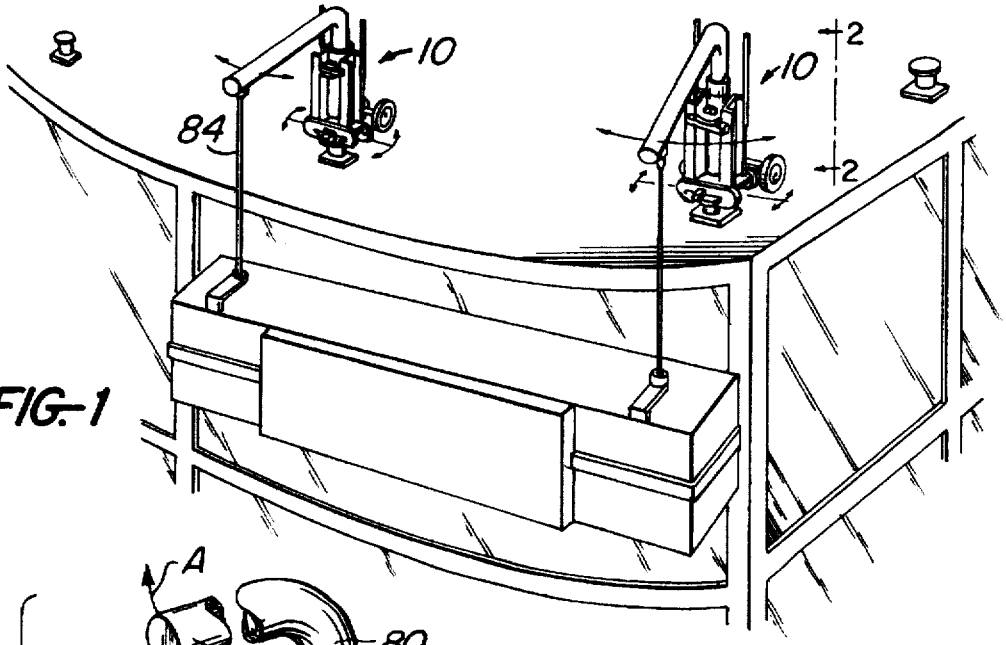
FIG. 1 is a perspective view showing davits supported by mounting assemblies according to the invention, disposed in relation to a rounded building contour and disposed at selected angles for positioning of suspended platform.

A tubular socket 70 is disposed between wall members 42, 44 and seats on support member 22 (FIGS. 2 and 3). A conventional davit 80 is receivable in socket 70, as shown, and has an upper bent portion which extends outwardly and on which is mounted a linkage 82 to support a woven-wire cable 84, two of which cables, suspended from respective davits, support a platform for persons performing services on a structure or building (FIG. 1).

The davit 80 is receivable in and rotatable relative to socket 70, as indicated by the arrow A in FIG. 2, arrows B and C in FIG. 4, and the broken-line showing at 27 of a different relative rotational position of the davit mounting assembly on mounting plate 12.

To engage the davit mounting assembly on circular disk 12, the assembly and hook member 24 are moved to engage hook member 24 on the mounting plate (as indicated in FIG. 2) without requiring great care for alignment. Such coupling remains effective until pin 28 is removed and the components are moved apart.

An important feature of the invention is the provision of the generally circular mounting plate 12, which replaces conventional square or rectangular plates, and which enables the engagement of a davit mounting assembly relative to the mounting plate at any selected rotational angle or position by enabling rotational movement of the socket relative to the mounting plate. Great versatility is thus provided to enable the positioning of the davit at any desired angle, thus to accommodate the positioning of a suspended platform at any desired angle or position, whereby there are accommodated rounded, curvilinear or other configurations of building portions or corners, which cannot be accommodated by conventional mounting plates. That is, the davit is not restrained to positions 90 degrees apart, as are conventional mounting plates, which limit davit mounting assemblies to such 90 degrees-apart positions.

Shown in FIG. 1 are two davits disposed on a roof top and suspending a platform at a rounded corner portion of a building. Such a curvilinear feature is readily accommodated, the davit mounting assemblies being positionable at virtually any angle.

To install the davit 80 in socket 70 or to remove it therefrom, pin 78 is removed from tubular member 56, whereupon socket 70 is rotatable by its pivotal mounting to a tilted position (FIG. 5) to receive or to remove a davit. It is generally impracticable or unfeasible to insert or remove a davit relative to the socket with the socket vertical, as will be appreciated from the geometry and arrangement of components. As is conventional, with the socket tilted, the davit is slid thereinto or removed, the socket is then tilted to its vertical position, and pin 78 is replaced in member 56 to secure the socket in vertical position.

Thus there has been shown and described a novel davit mounting assembly which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A davit mounting assembly, comprising:

a generally circular mounting plate secured on a pedestal mounted on an elevated surface of a structure, and a davit mounting assembly adapted to be removably and rotatably mounted on said mounting plate, said davit mounting assembly being adapted to receive a davit, whereby the davit mounting assembly is rotatable on the mounting plate for positioning thereof in any selected rotational position relative to the mounting plate.

2. A davit mounting assembly according to claim 1, wherein said pedestal is rigidly secured on a building top.

3. A davit mounting assembly according to claim 1, wherein the pedestal has a portion embedded in concrete on the elevated surface of a structure.

4. A davit mounting assembly according to claim 1, wherein said davit mounting assembly includes hook members defining channels to receive said mounting plate.

5. A davit mounting assembly according to claim 1, wherein the davit mounting assembly includes a socket adapted to receive the davit.

6. A davit mounting assembly according to claim 5, wherein said socket is pivotally mounted for positioning in an inclined position to facilitate insertion and removal of a davit relative thereto.

7. A davit mounting assembly according to claim 1, and further including wheel means for movement of the davit mounting assembly for selective positioning thereof on said elevated surface of a structure.

8. A davit mounting assembly for receiving a davit for suspending a platform to support persons thereon, comprising:

a generally circular mounting plate secured on a pedestal on an elevated surface of a structure, a tubular socket in the davit mounting assembly to receive therein a davit, a support plate and spaced apart wall members thereon for receiving the tubular socket, spaced apart hook members mounted on the support plate and defining channels to receive said mounting plate in rotatable relation to said support plate, and means for removably retaining said davit mounting assembly on the mounting plate.

9. A davit mounting assembly according to claim 8, and further including:

spaced-apart members mounted on the socket and defining registering openings, and wherein said means for removably retaining the davit mounting assembly comprises pin means insertable through said registering openings to retain the socket.

10. A davit mounting assembly according to claim 8, wherein:

the socket is pivotally mounted relative to said spaced apart wall members for rotation of the socket to a position to facilitate insertion and removal of a davit.

11. A davit mounting assembly according to claim 8, wherein:

said davit mounting assembly is adapted to be mobile, and transportable to selected positions.

* * * * *